US009685051B2

(12) United States Patent
Turner et al.

(10) Patent No.: US 9,685,051 B2
(45) Date of Patent: Jun. 20, 2017

(54) EVACUATION ASSISTANCE APPARATUS

(71) Applicant: BRIGHT ROUTE LIMITED, Durham (GB)

(72) Inventors: Andrew Turner, Durham (GB); William Scott, Cleveland (GB); David Frame, Tyne and Wear (GB)

(73) Assignee: BRIGHT ROUTE LIMITED (GB)

( * ) Notice: Subject to any disclaimer, the term of this patent is extended or adjusted under 35 U.S.C. 154(b) by 0 days.

(21) Appl. No.: 14/768,266

(22) PCT Filed: Feb. 17, 2014

(86) PCT No.: PCT/GB2014/050453
§ 371 (c)(1),
(2) Date: Aug. 17, 2015

(87) PCT Pub. No.: WO2014/125301
PCT Pub. Date: Aug. 21, 2014

(65) Prior Publication Data

US 2016/0042615 A1 Feb. 11, 2016

(30) Foreign Application Priority Data

Feb. 15, 2013 (GB) ..... 1302689.3

(51) Int. Cl.
*G08B 5/36* (2006.01)
*G08B 5/38* (2006.01)
*G08B 7/06* (2006.01)

(52) U.S. Cl.
CPC ..... *G08B 5/38* (2013.01); *G08B 7/066* (2013.01)

(58) Field of Classification Search
CPC ..... G08B 5/38
USPC ..... 340/815.66
See application file for complete search history.

(56) References Cited

U.S. PATENT DOCUMENTS 5,572,183 A * 11/1996 Sweeney ..... G08B 7/066 340/332
6,150,943 A * 11/2000 Lehman ..... G08B 7/066 340/332
2010/0044564 A1* 2/2010 Suziki ..... G01R 33/282 250/306

(Continued)

FOREIGN PATENT DOCUMENTS

DE 102008017656 10/2009

OTHER PUBLICATIONS

Corresponding UK IPO Search Report dated Aug. 19, 2014.
Corresponding International Search Report for PCT/GB2014/050453 dated Jun. 5, 2014.

*Primary Examiner* — Santiago Garcia
(74) *Attorney, Agent, or Firm* — The Belles Group, P.C.

(57) ABSTRACT

An evacuation assistance apparatus for indicating a route within a building or other structure is disclosed. Multiple housings contain laser light line sources for producing a beam of laser light as a linear line. Adjusters are used to alter the laser light line so that the line starts substantially vertically below said housing. The adjusters also allow the line to be directed on to a portion of the wall to highlight an exit doorway. The apparatus is provided as a modular system including multiple sensors making it suitable for installation in many buildings and providing feedback information to prevent or determine the cause of a fire.

19 Claims, 7 Drawing Sheets

(56) References Cited

U.S. PATENT DOCUMENTS

| | | | | |
|---|---|---|---|---|
| 2011/0007496 | A1* | 1/2011 | Chien | F21S 4/28 362/157 |
| 2011/0157486 | A1* | 6/2011 | Murata | G08B 7/062 348/744 |
| 2013/0293681 | A1* | 11/2013 | Borowski | G01S 7/483 348/46 |
| 2014/0168940 | A1* | 6/2014 | Shiomi | B60Q 1/0023 362/84 |
| 2015/0094859 | A1* | 4/2015 | Awerbuch | B23D 47/08 700/275 |

* cited by examiner

FIG. 4
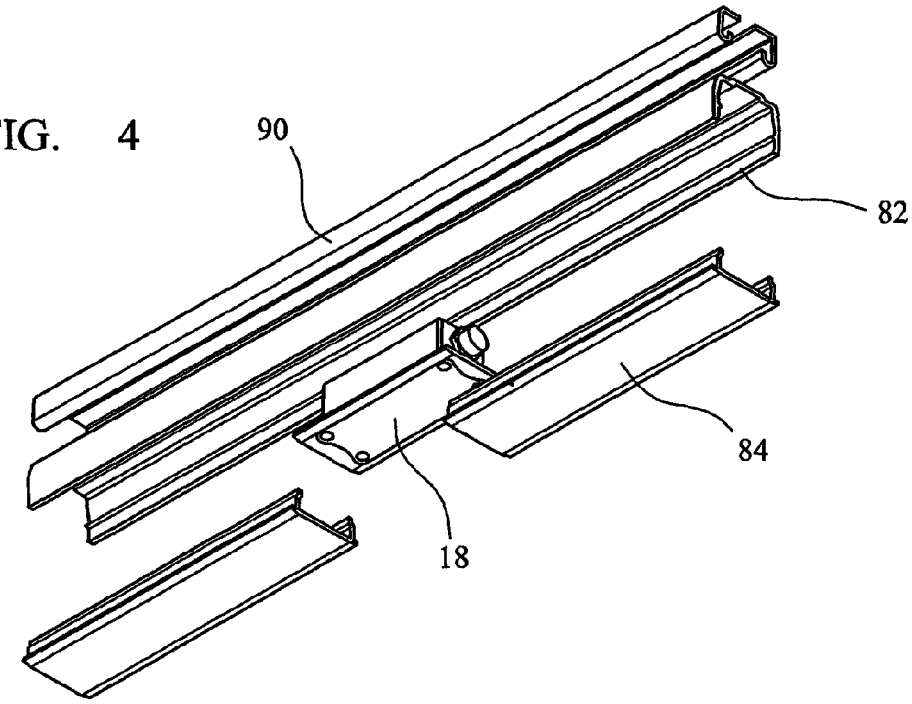
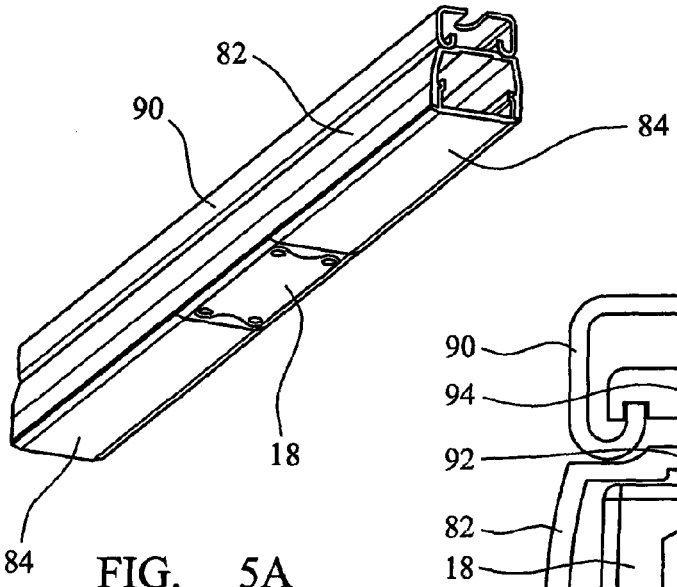
FIG. 5A
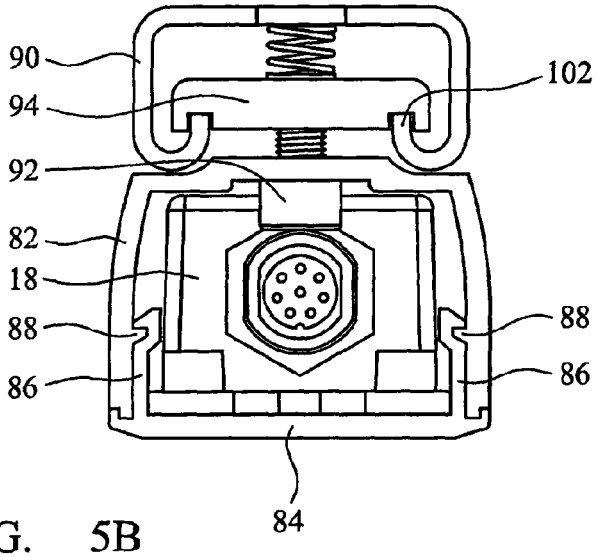
FIG. 5B

FIG. 8
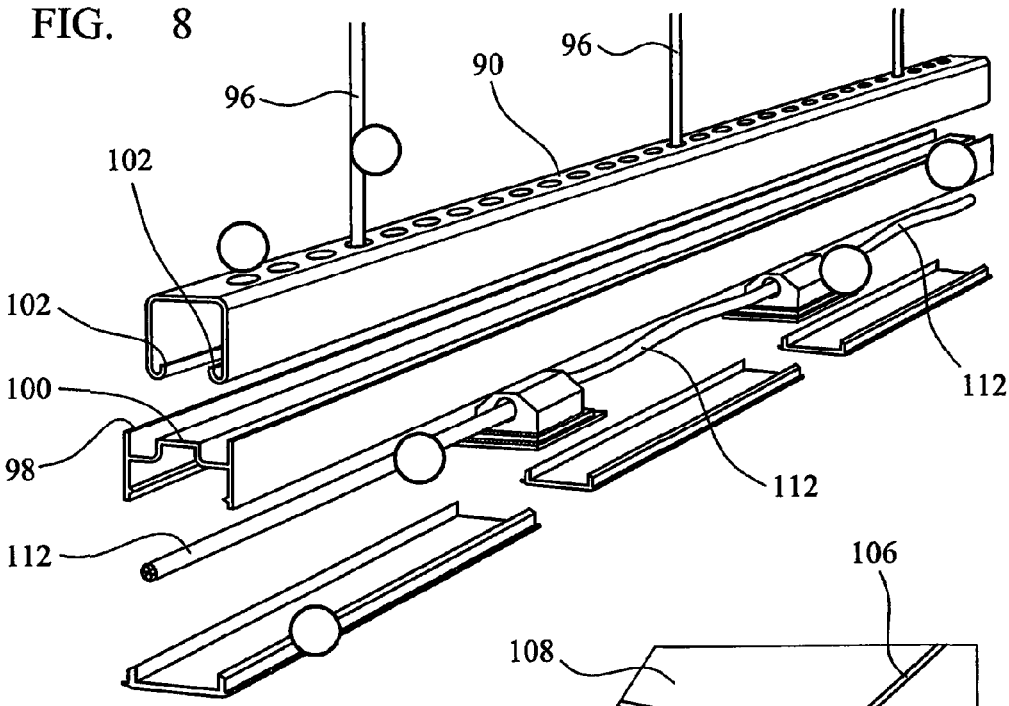
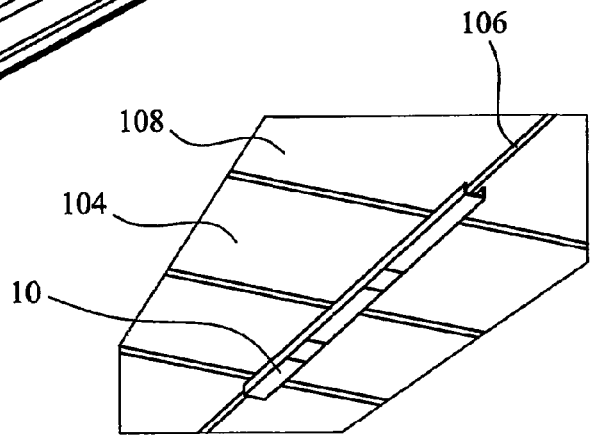
FIG. 9
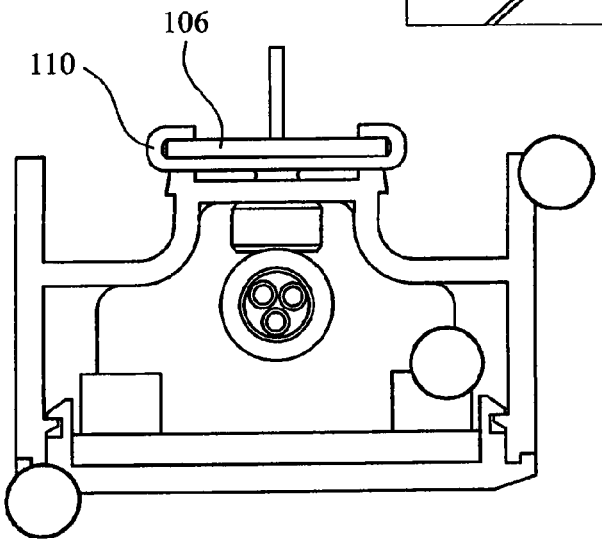
FIG. 10

EVACUATION ASSISTANCE APPARATUS

CROSS-REFERENCE TO RELATED PATENT APPLICATIONS

The present application is a U.S. national stage application under 35 U.S.C. §371 of PCT Application No. PCT/GB2014/050453, filed Feb. 17, 2014, which in turn claims priority to U.K. Application No. 1302689.3, filed Feb. 15, 2013, the entireties of which are incorporated herein by reference.

The present invention relates to an evacuation assistance apparatus and relates particularly, but not exclusively, to an apparatus for assisting in the evacuation of people from smoke filled rooms, corridors and the like in buildings and other structures.

The safe evacuation of people from buildings such as hotels and office blocks, and other locations where people are housed, such as and oil rigs, is well known and is of paramount concern. This is particularly the case when the danger causing the required evacuation is fire due to the significant risk to life and the well-known significance that the speed of evacuation has on survival rates.

An example of an apparatus for assisting with evacuation is disclosed in International Patent Application Publication number WO99/10234. The apparatus described therein uses a series of lasers mounted in the ceiling of an aircraft cabin and directed to beam laser light to the floor. The laser light reflects on smoke particles, if they are present in the air, forming a wall of light which can be used to mark a route to an exit. Although such an apparatus is useful in a simple linear structure such as an aircraft, where the cabin containing the passengers exits straight to safety without the complexity of corridors, the apparatus has significant shortcomings when applied to more complicated floor plan arrangements within buildings with rooms and corridors as well as exits via stairs. Furthermore, the apparatus is described for use by integration into newly constructed space such as an aircraft and does not lend itself to retrofitting to existing buildings and structures.

It is also known to provide lighting apparatus for assisting in the evacuation of people from buildings and structures where all lighting has been lost. Such apparatus may include LED lighting fitted into the floor and stairs of the building. The fitting of such lighting is expensive even when undertaken during the construction of the building but is particularly difficult to retrofit. Furthermore, such lighting is subject to wear and damage, requiring regular maintenance and replacement of components.

Preferred embodiments of the present invention seek to overcome the above described disadvantages of the prior art.

According to an aspect of the present invention there is provided an evacuation assistance apparatus for indicating a route, the apparatus comprising:

at least one source of electrical power;

a plurality of housings containing at least one laser light line source for producing a beam of laser light that forms a substantially linear line on a planar surface and having line adjuster means for altering the laser light line so that the line starts substantially vertically below said housing.

By providing a laser light apparatus that produces a line that can be altered to start directly below the housing containing the laser light source, the advantage is provided that a wall of laser light can be provided but portions of that wall can be masked off allowing the apparatus to navigate corners and to indicate where doorways are present. For example, the adjustment of the laser line (either its length or beam angle) can be so that the line starts vertically below the laser light source extending away from that starting point. This can be used to mark the end of a portion of a wall, for example as a corner or to indicate a doorway. This indication of a doorway can be used in a corridor where doorways into rooms are indicated by spaces in the wall of laser light. This has the advantage of not disorientating a person attempting to exit a room into the corridor since a wall of laser light directly in front of the door may disorientate a person trying to exit through the door wasting vital seconds and potentially further endangering their life. Furthermore, the gap in the wall of laser light indicates to personnel from the fire rescue services that the door is present to a room that may be occupied. It is easy to distinguish a doorway, which remains unlit, from a corner of a corridor because at the corner of a corridor the lines of laser light will continue directing a person towards the exit. As a result, people trying to escape from the building are easily able to distinguish the route out but at the same time fire rescue service personnel who are attempting to assist in the evacuation and check rooms, are able to identify where the doorways are even in thick smoke. Thus the laser apparatus of the present invention replicates the exact building layout.

In a preferred embodiment the adjuster means comprises at least one first adjuster for altering the angle of the laser light line source within the housing.

In another preferred embodiment the adjuster means comprises at least one second adjuster for altering the length of said line of said laser light.

In a further preferred embodiment the second adjuster comprises at least one mask for partially blocking said beam of laser light According to another aspect of the present invention there is provided an evacuation assistance apparatus for indicating a route, the apparatus comprising:

at least one source of electrical power;

a plurality of housings containing at least one laser light line source for producing a beam of laser light that forms a substantially linear line on a planar surface and having line adjuster means to direct said line at least partially along a substantially vertical surface.

In a preferred embodiment the line extends at least partially around a doorway formed in said substantially vertical surface.

By extending the line of laser light up a wall, in particular around a doorway, the advantage is provided that an exit doorway can be easily distinguished from a doorway that does not lead to an exit. As previously described it is important to be able to identify doorways, in order to allow fire service personnel to identify potentially occupied rooms. However, it is also important that a safe exit is clearly marked and by using the laser light to draw a line around a doorway allows the distinction between a doorway leading towards the exit and a doorway leading towards a dead end to be clearly made.

In another preferred embodiment at least one first laser light line source, directed to shine said laser light on a substantially horizontal surface, produces light at a first colour frequency and at least one second laser light line source, direct to shine said laser light on a substantially vertical surface, produces light at a second colour frequency.

By further distinguishing an exit by using a different coloured laser light the above advantages are further enhanced.

According to a further aspect of the present invention there is provided an evacuation assistance apparatus for indicating a route, the apparatus comprising:

at least one source of electrical power;

a plurality of laser modules comprising at least one laser light line source for producing a beam of laser light that forms a substantially linear line on a planar surface;

at least one sensor module containing at least one sensor for measuring at least one parameter relating to the environment adjacent the sensor and for providing data relating to said parameter to said control system;

at least one control system for controlling whether said laser light sources are operating or not operating;

at least one mounting track for mounting a plurality of said modules thereon; and a plurality of connectors for connecting said modules to at least one said source of electrical power and at least one said control system.

By using a modular system including modular lasers and modular sensors the advantage is provided that the apparatus can be fitted to many different locations and types of buildings and structures. For example, the apparatus can be easily fitted into a corridor with multiple rooms extending therefrom so as to provide the unlit doorways described above by situating a laser module either side of the door frame. Furthermore, the apparatus can be used to operate over large expanses, such as might be found on an oil rig, where the modular system is provided with multiple power sources linked together.

In a preferred embodiment at least one sensor comprises at least one of a smoke detecting sensor, a temperature sensor and a light sensor.

In another preferred embodiment the control system switches said laser light sources on and off in a sequence indicating a recommended route for evacuation.

According to another aspect of the present invention there is provided an evacuation assistance apparatus for indicating a route, the apparatus comprising:

at least one source of electrical power;

a plurality of housings containing at least one laser light line source for producing a beam of laser light that forms a substantially linear line on a planar surface at least one control system for controlling whether said laser light sources are operating or not operating;

at the least one light level sensor for measuring light levels and providing data relating to said light level to said control system, wherein said control system turns on a plurality of said laser light line sources in response to data from at least one said light level sensor indicating that the light level had dropped below a predetermined level.

By providing a light level sensor, the advantage is provided that the apparatus described above can be used in situations where smoke is not present but light levels have decreased to the point where it is difficult to see an evacuation route. In this situation the laser light will not be visible forming a wall due to the absence of smoke particles. However, in this instance the laser light will simply hit the floor and will provide illuminated pathways for people to follow. Because the light source is provided overhead the advantage is provided that it is less likely to be damaged than lighting that is placed on the floor. Furthermore, the installation and maintenance of such a laser light system is significantly less than providing, for example LED lights in the floor. It is also the case that the installation of such a system on non-planar surfaces, for example stairs, is significantly easier than the installation of strips of LED lights. The laser light system simply adapts to the shape of the floor surface that the laser light engages. This may also be used as an energy saving way to navigate corridors for example in hospitals at night. Many hospitals dim lighting systems at night and the present invention projects a safe and very energy efficient pathway during operational hours. The apparatus is also useful on for example military ships where blackout conditions are often maintained to ensure no light can be seen by enemy vessels and aircraft. The apparatus creates a pathway with no visible signs from outside the ship.

The apparatus may further comprise at least one retro-reflective tape for sticking to surfaces aligned with the position of said line of said laser light.

By using retro-reflective tape, the advantage is provided that the line indicated by the lasers is very clearly let even on darker surfaces but the retro-reflective tape is in obtrusive when laid on the floor.

Preferred embodiments of the present invention will now be described, by way of example only, and not in any limitative sense, with reference to the accompanying drawings in which:

FIG. 4 is a perspective exploded view of a tracking system is used in the apparatus of the present invention including the module shown in FIG. 3;

FIGS. 5A and 5B are a perspective view and an end view of the tracking system of FIG. 4;

FIG. 8 is an exploded perspective view of the tracking system of FIG. 4 together with a mounting device;

FIG. 9 is a perspective view of a section of the apparatus of the present invention;

FIG. 10 is an end view of the apparatus of FIG. 9;

Figure 1:
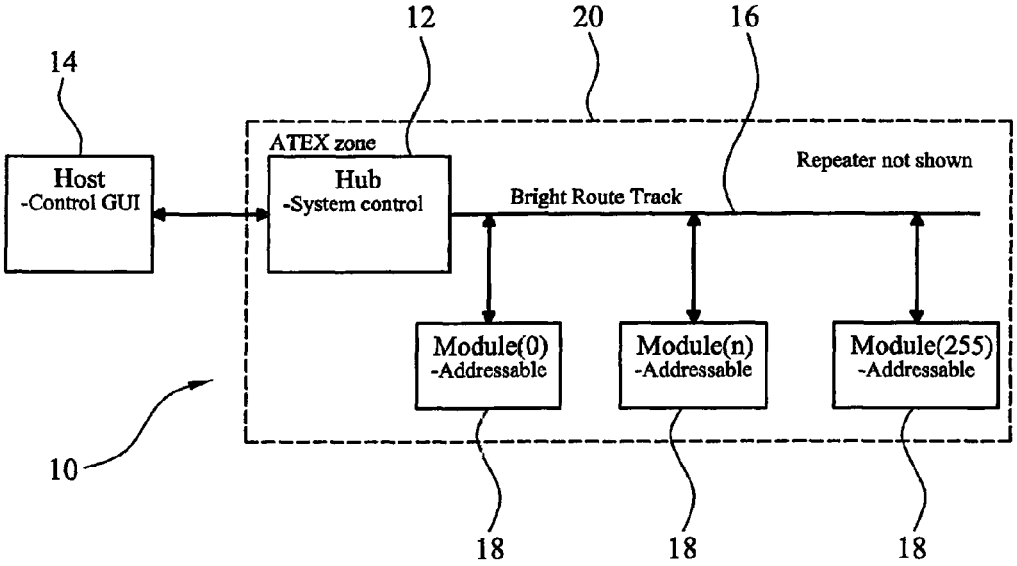
FIG. 1 is a schematic representation of the apparatus of the present invention.

Referring to FIG. 1, an evacuation assistance apparatus 10 includes a local control system or hub 12 and an overall control system or host 14. Connected to the hub 12 via a system of tracks 16 are a plurality of modules 18. The hub 12 provides electrical power to the modules 18 and data and instruction signals are sent between the hub 12 and modules 18. The hub 12 contains a mains power source and a battery backup source. The mains power is stepped down using a transformer to provide lower voltage power via track 16 to modules 18. The hub 12 tracks 16 and modules 18 are all contained within an explosion proof or ATEX zone 20. The host system 14 is typically a standard computer device is connected via a network, and possibly located a significant distance away and connected via the Internet, to the hub 12. The host system 14 is used to provide overall control of the apparatus 10 and a graphical user interface is provided to indicate the layout of the tracks 16 and modules 18 and the operational status and other data relating to the modules 18. If the number of modules required exceeds the number of modules the hub can support) for example due to insufficient power), a further hub may be installed to act as a repeater.

Figure 2:
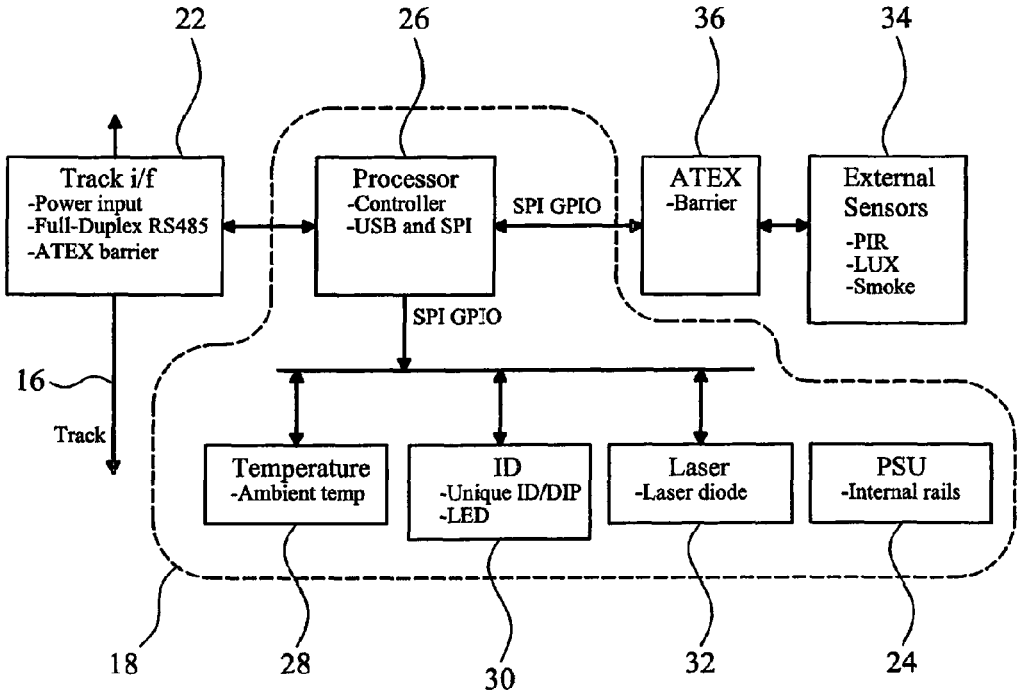
FIG. 2 is a schematic representation of a module forming part of the apparatus of FIG. 1.

Referring to FIG. 2, the module 18 is connected to tracks 16 via a track interface 22. The track 16 carries power and data between each of the modules 18 and the hub 12. The track interface 22 provides an ATEX barrier to the components contained within the module 18. The module 18 contains a power supply unit (PSU) 24 that draws power from the track interface 22 and provides it to the components of the module 18. A processor 26 receives from and provides data back to the hub 12 as well as controlling other components contained within the module 18. A temperature sensor 28 detects the ambient temperature within the module and provides data to the processor 26. An identifier 30, which provides a unique ID for each module 18 is also provided. This allows the hub 12 to send and receive messages specifically relating to one module 18. At least some of the modules 18 include a laser light line source 32 which produces a substantially linear line of laser light when the laser light line source 32 projects its beam of light onto a plane surface. As will be familiar to persons skilled in the art, the laser light line source 32 includes a laser diode and lenses that take the point source beam of laser light and spread it to form a line. Typically this line has a predetermined fan angle of for example, 40°, 60° or 90°. As an adjunct to module 18 and external sensor 34 may be connected, via ATEX barrier, to processor 26.

Figure 3:
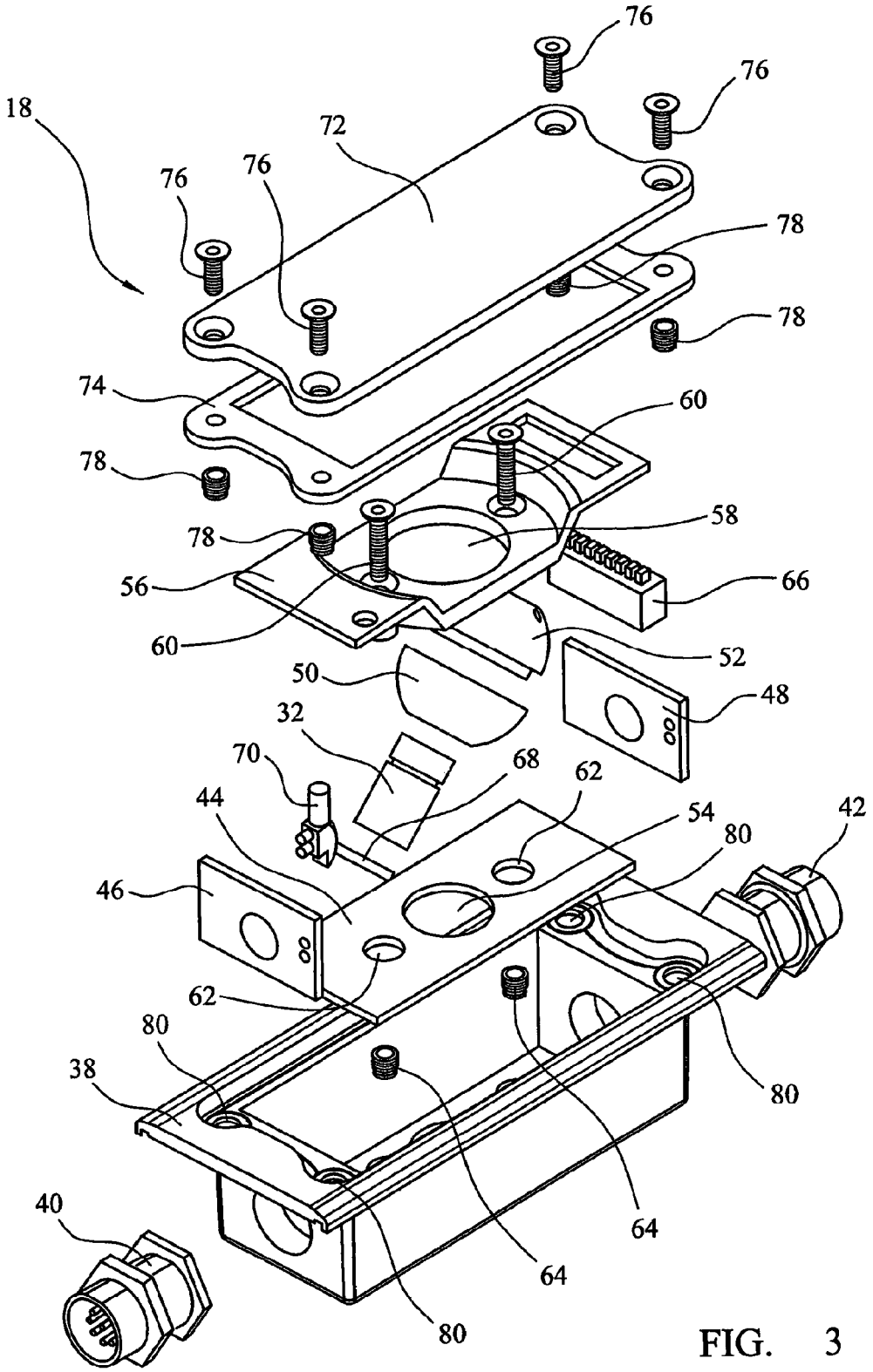
FIG. 3 is a perspective exploded view of the module shown schematically in FIG. 2.

An example of a module 18 is shown in detail in FIG. 3. The module 18 includes a housing 38 into which extend male and female cable connectors 40 and 42. Printed circuit board 44 is located at the base of housing 38 and additional printed circuit boards 46 and 48 are also provided. These printed circuit boards carry the control circuitry for all of the apparatus operated within module 18 including temperature sensor 28 and processor 26. The laser light line source 32 is contained within a ball formed in two halves of a ball base 50 and a ball top 52. The ball 50, 52 sits in a circular aperture 54 in printed circuit board 44. A clamping plate, that also has a circular aperture 58, is also located on to ball 50, 52 and clamped into place by bolts 60 that extend through Bolt apertures 62 and into nuts 64 that are located and fixed to the bottom of housing 38. In the embodiment shown in FIG. 3 the identifier 30 is provided in the form of an eight switch DIP switch 66. The eight switches allow for 255 different modules to be uniquely identified and separately connected to hub 12. A further printed circuit board 68 is provided for the laser light source 32. An LED and associated light tube 70 are also provided to act as an externally visible status indicator allowing the operational status of the module 18 to be easily identified by external visual inspection. The housing 38 is closed using a transparent sealing plate 72 which compresses a seal 74 against the housing 38 to provide an ATEX approved seal around the housing. Four bolts 76 and associated nuts 78, which are located in recesses 80 in housing 38, are used to perform this clamping function.

Referring to FIGS. 4, 5A and 5B, the module 18 is for use in conjunction with a conduit system for carrying the connecting cables. This constitutes the physical aspect of the track 16 schematically shown in FIGS. 1 and 2. The conduit system includes a conduit body 82 that is formed by extrusion into long lengths and lid portions 84 also formed by extrusion and cut to the required length. The lid 84 fixes to the body 82 using clipping arms 86 that extend into conduit body 82 and engaging ridge 88 that extends along the length of the conduit body 82. It will be apparent to persons skilled in the art that other suitable mechanical fixing means may be used. The module 18 is fixed into the conduit body 82 by some suitable securing means. This could for example include a fixing including arms similar to the clipping arms 86 to engage the ridges 88. Alternatively, a screw fixing may be used. In order for the apparatus of the present invention to operate it must be suspended at a suitable distance above the ground so that the lasers are able to direct their light from the modules to the floor. Various fixing techniques are suitable for suspending the trunking parts 82 and 84 and modules 18 at this suitable distance above the floor. One example of this is the well-known Unistrut, a length of which is indicated at 90. Conduit body 82 is then fixed to the Unistrut 90 using a series of fixing spaced apart along the length of the Unistrut, each fixing including a bolt 92 and a spring channel nut 94. An alternative embodiment is shown in FIG. 8 in which the Unistrut 90 is suspended from suspension bars 96. This arrangement can be used where the ceiling of the structure within which the apparatus is contained is significantly higher than the typical height of a person, for example where the apparatus is being used on an oil rig. In this embodiment, instead of the bolt 92 and spring channel nut 94, the alternative conduit body 98 is formed with a central ridge 100 that can engage and fix to the interned edges 102 of Unistrut 90. This system removes the need to form a hole in the length of conduit body.

Referring to FIGS. 9 and 10, the apparatus may be installed on a suspended ceiling 104 by utilising the tile support 106 that carry the ceiling tiles 108. A clamp 110 is attached to the conduit body 98 and is then fixed to the tile support 106.

Installation of the apparatus 10 will now be described. The conduit body 82 or 98 is attached to the building or structure using the Unistrut or other means described above. Modules 18 are then fixed into place at appropriate spacing to provide suitable coverage of the laser line. Typically this is the installation of modules 18 containing laser line sources 32 at a spacing of 2 meters or less. The modules 18 are connected together using connecting cables 112 which have plugs 114 attached thereto, these plugs being suitable for insertion into sockets 40 and 42. The cables 112 and plugs 114 are of a type suitable for carrying power from a hub 12 to the modules 18 and data from the modules 18 to the hub 12. The combination of the cables 112 and the modules 18 together form the electronic components of the track 16. In a chain of modules 18 extending from hub 12, the module 18 that is furthest away from the hub 12 communicates through each of the cables 112 and each of the modules 18 between it and the hub. The modules 18 are provided with a pass-through function that ensures that even if the module 18 stops functioning the power and data are able to pass though non-functioning module.

The apparatus 10 also includes one or more sensors for determining environmental parameters relating to the location where the apparatus 10 is installed. These sensors include lux or light sensors, smoke detectors, passive infrared movement detectors and temperature detectors. These sensors can be located in modules that appear similar to the modules 18. These modules will be included in the trunking system and connected via further cables 112. Alternatively, the sensors may be located separately from the conduit and connected either via a T-connection formed in one of the laser modules 18, as shown functionally in FIG. 2, or in a separate module that acts purely as a T-connection.

The data gathered by the sensors are relayed back along track 16 to the hub 12 and passed on to the host 14 where this data is stored. Because the host 14 is generally located remotely from the hub 12 this data is put checked it and can be easily retrieved. For example, in the event of a catastrophic fire which ultimately destroys the building in which it is housed, the data gathered and stored by the host 14 can be reviewed and analysed at a later date to provide information relating to the seat of the fire and the manner in which progressed and spread through the building. The host 14 is therefore acting in a similar manner to a "black box" used in aircraft. Furthermore, because the sensors gathered data at all times, irrespective of whether the laser modules are being used to provide laser light illumination, the data gathered can be used to other safety systems and initiate a fire alarm in the event of certain conditions being met. Some sensors, for example the temperature sensors, can be used to assist in fire prevention by alerting to a raised temperature at a particular location which may indicate a risk that the fire is about to start and allow the source of the raised temperature to be deactivated or otherwise dealt with. An example of the location of a sensor within the apparatus of the present invention is illustrated in FIG. 11 at 115.

As part of the installation process the laser line produced by the laser line source 32 should be aligned correctly with other lines and to indicate the location of key features of the building or structure, for example indicating the exit and indicating doors leading to rooms that may be occupied but that do not lead to an exit. As can be seen in FIG. 3, the ball 50, 52 containing the laser light line source 32 can be moved to alter the angle at which the laser light line source is pointing. The module 18 is installed into the conduit body 82 with the plate 72 and bolts 76 removed. The fixing plate 56 is loosened by the slackening of bolts 60 so that the ball 50, 52 can be moved in so as to point in any direction from within the apertures 54 and 58. With the laser light source 32 turned on the angle of the laser light source within the module 18 can be changed from positions shown in FIG. 6. The use of a ball and socket arrangement, as described above, gives multiple degrees of freedom of adjustment. For example, with the laser light source 32 pointing directly down, the fan shaped beam of laser light 116 has edges indicated as E1 and E2. This is the standard orientation of the laser light source 32 within module 18. If a series of modules 18 are aligned next to each other at a spacing of, for example 2 meters, with the laser light line source 32 aligned pointing directly down, as described above, the overlapping laser light produces a curtain of laser light when the laser light is able to reflect on small particles, such as smoke or droplets of water. However, such an arrangement is unsuitable in some situations. For example, where the apparatus 10 is being used in a corridor it is important that the exit doors can be easily identified so that persons trying to escape can easily find the exit. At the same time, doors to rooms within the building or structure that may be occupied but do not lead to an exit should also be identified. This is particularly the case because fire service personnel may need to check each potentially occupied room and the curtain of laser light may prevent them from identifying the door is present and requires investigation.

Figure 6:
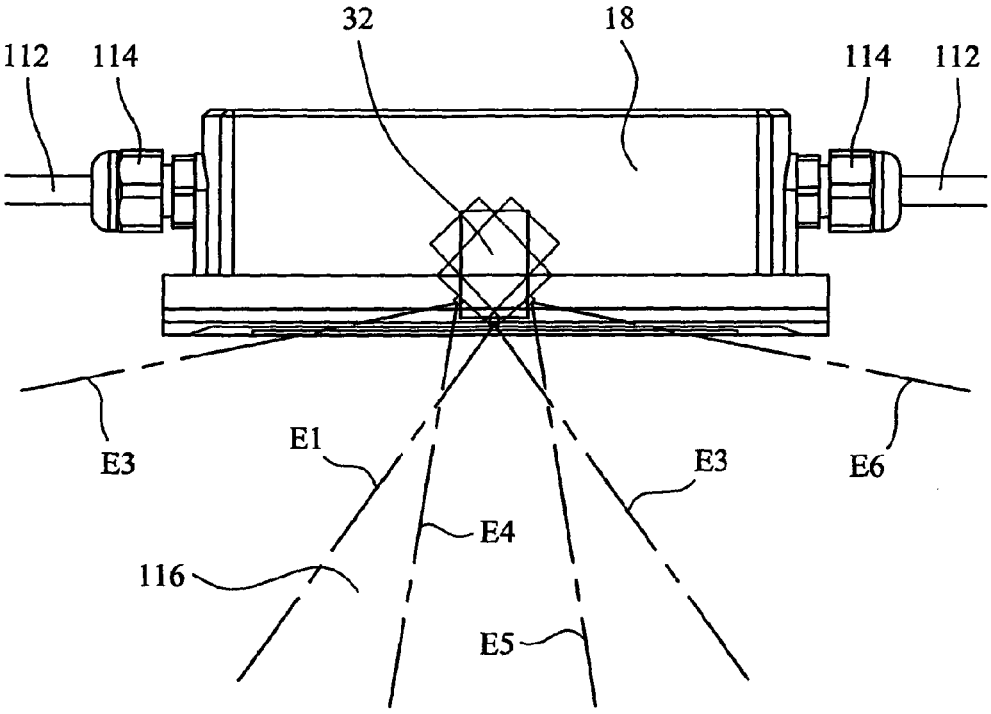
FIG. 6 is a side view of the module of FIG. 3.
Figure 7:
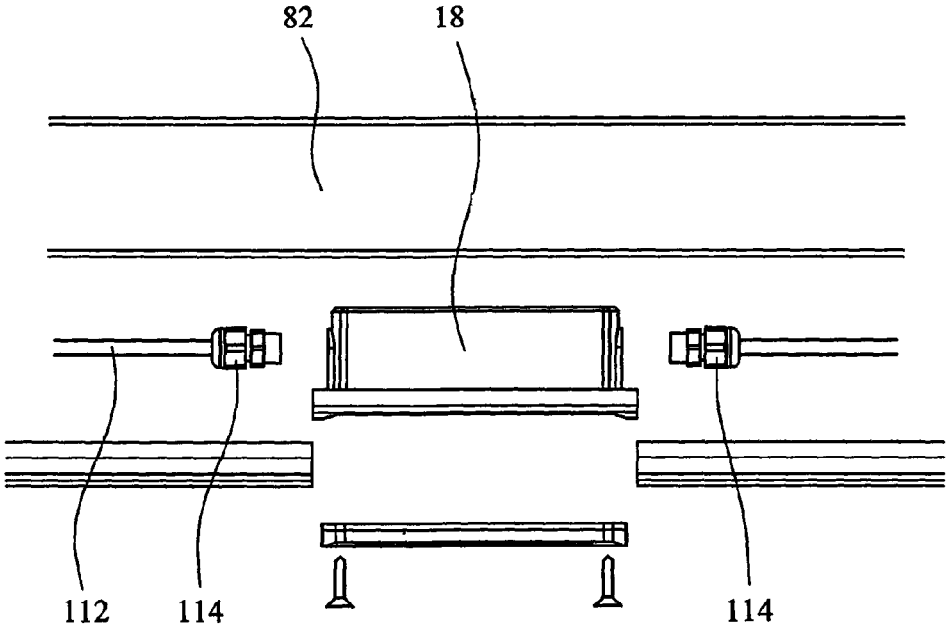
FIG. 7 is an exploded side view of the tracking system of FIG. 4.
Figure 11:
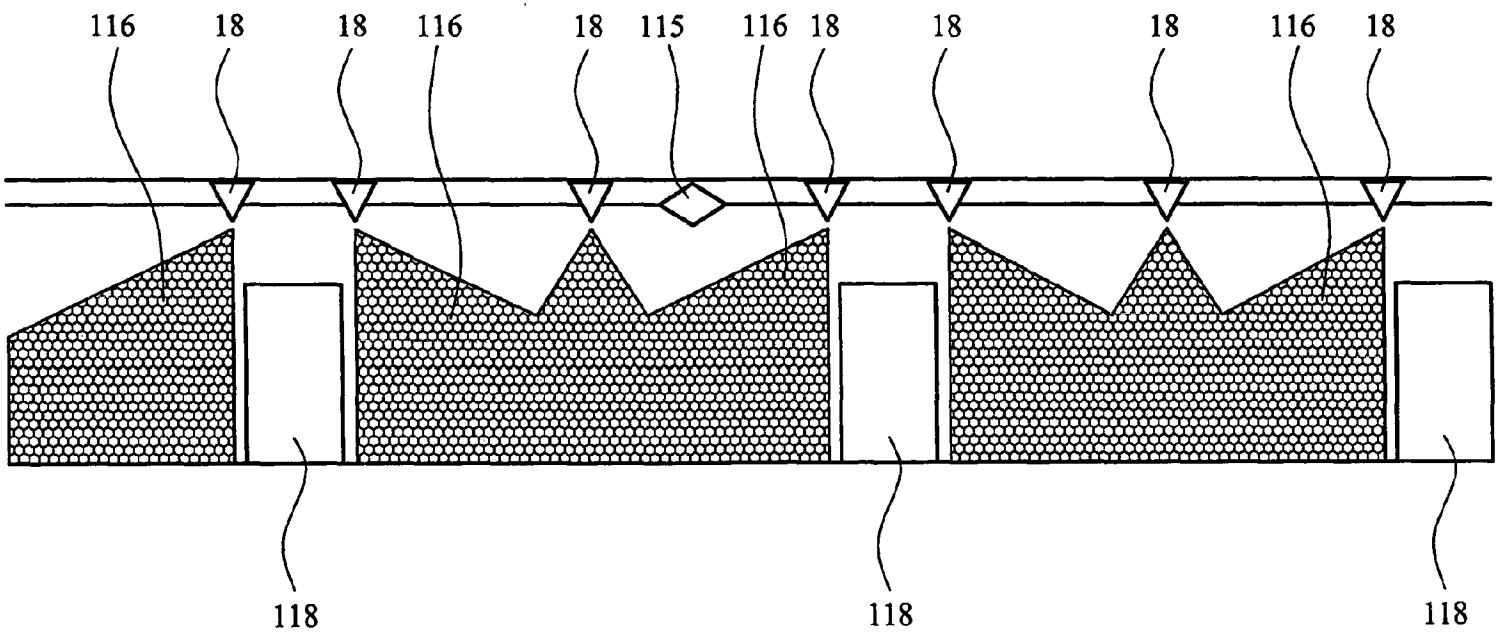
FIG. 11 is a schematic representation of the apparatus of the present invention in use.

Referring also to FIG. 11, where a module 18 is installed adjacent a door 116 the angle of the laser light source 32 within module 18 is adjusted so that the laser light coming from the module 18 begins substantially below the module 18 and extends away from the door 116. Such adjustments are shown in FIG. 6. For example, in one orientation the laser light source 32 is angled so that the edges of the laser light beam 116 are now indicated at E3 and E4. A further orientation in the other direction gives the edges of the beam 116 as indicated at E5 and E6. As can be seen in FIG. 6 the edges E4 and E5 are able to pass beyond the vertical alignment but in the situation illustrated in FIG. 11 it is vertical alignment of the edge of the laser line resulting in a laser light curtain that has an edge that is parallel to the vertical doorframes of the doors.

Figure 12:
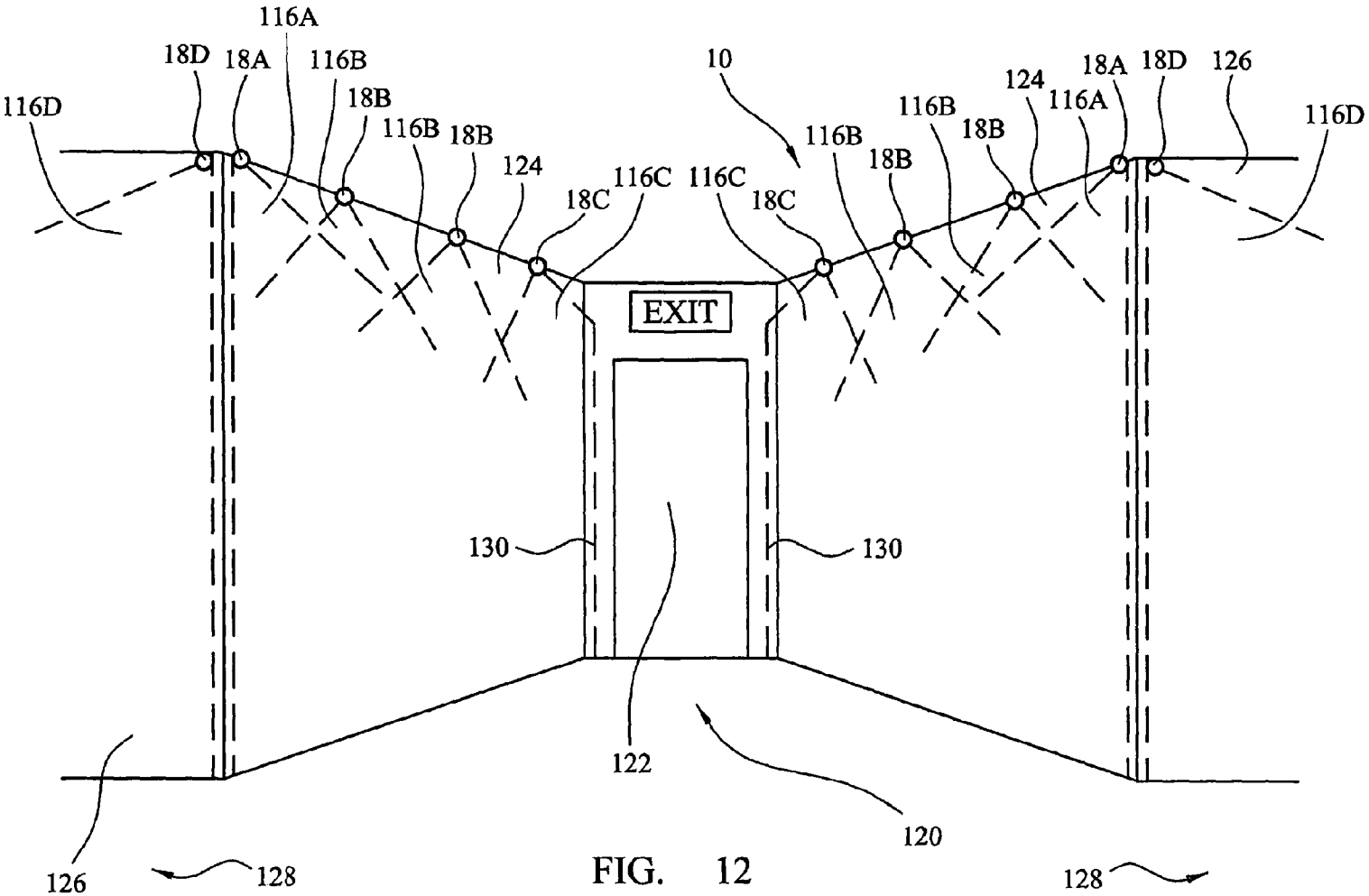
FIG. 12 is another schematic representation of the apparatus the present invention in use.

Referring to FIG. 12, a corridor 120 leads to an exit door 122. The apparatus 10 is installed and is represented schematically in FIG. 12 with four modules 18 on each of the walls that defined the corridor 120. The modules 18 are labelled 18A, 18B and 18C to indicate the different functions performed by the laser light line sources 32 in each of these modules. The modules 18A are located at the ends of walls 124 that are furthest away from exit 122 and that form a corner with the adjacent walls 126 that form a corridor 128 extending perpendicular to corridor 120. The laser light sources 32 in modules 18A have been aligned so that one of the edges of the laser light beam 116A extends vertically downwards parallel to the edge of wall 124. As a result, the beam of laser light 116A does not extend beyond the edge of wall 124 and into corridor 128. Moving along the corridor 120 towards the exit 122 two further modules, labelled 18B, have laser light sources that are aligned to point vertically downwards so that the spread of the laser beams 116B are approximately equal either side of a line extending vertically down from the modules 18B. Closest to the door is the last module 18C and the laser light source 32 in this module is angled to point towards the wall in which door 122 is formed. As a result, the laser light beam 116C forms a line indicated at 130 on the wall immediately adjacent to door 122. The laser light source 32 in module 18C is preferably a different colour from those in modules 18B and 18A. For example, the laser light source in module 18C could produce green laser light (in common with the colour used for exits signs) whereas the laser light sources in modules 18A and 18B could produce a red laser light. This difference in colour would assist people attending to evacuate the building or structure in finding the exit door 122. Further colours are also incorporated to identify features relating to the building or structure. For example, blue lasers are used to highlight and identify key pieces of safety equipment such as fire extinguishers. This is done by adding an additional module 18 with a blue laser and a narrow beam angle producing a shorter line than the standard modules described above and locating the additional module directly above the fire extinguisher. It should be noted that the corridor 128 is also provided with laser modules (indicated at 18D and producing beams 116D) as well as further modules which are not shown in FIG. 12. Because the laser modules 18D are in a corridor, and not at an exit, they would typically be red lasers in line with the colour system described above.

As a further assistance in the directing people towards an exit the laser light sources in the modules 18 could be caused to flash on and off in a sequence that appears to leads towards the next it. Furthermore, the processor 26 can interpret data from any sensors to calculate a preferred exit route. For example, temperature sensors may indicate that a particular portion of a structural building has a significantly raised temperature indicating the seat of a fire. The processor can use this information to determine what the best exit route from a given point is and flash the laser light sources in the modules to direct people towards a safe exit. In an alternative version, RFID tags are issued to and worn by people working in the building or structure. The RFID tags are read by readers located around the building to identify where people are located. This allows the hub to determine the best escape route from the location where people are known to be and then uses the flashing of the laser devices in the modules to indicate the route.

It will be appreciated by persons skilled in the art that the above embodiments have been described by way of example only and not in any limitative sense, and that various alterations and modification are possible without departure from the scope of protection which is define by the appended claims. For example, in addition to altering the angle at which the line of laser light produced by the laser light source 32 projects from the module 18, the length of line can also be altered. This adjustment to the length of the line, by a second adjuster, can be achieved by using a mask that is placed between the laser light source 32 and the transparent sealing plate 74. The mask could be in the form of a sheet of opaque material housed in a groove formed in the housing so that it can slide covering different portions of the sealing plate 74. A simple alternative is to use an opaque tape that is stuck to either the inside or the outside of the sealing plate 74. A further alternative is to mount an adjustable iris on the laser light source 32 so that rotation of the laser light source causes the iris to expand and contract lengthening and shortening the line of laser light produced. As a result, it can be seen that the apparatus of the present invention multiple degrees of freedom when aligning the line produced by the laser light line source. Firstly, the location of the module can be changed sliding the module within the conduit. Secondly, the length of the line can be altered using, for example, the masking technique described above. Finally, the containing of the laser light line source within a ball and clamping that ball between two plates containing apertures allows complete free movement of the ball including all three axes of movement, axis I running axially along the conduit/track, axis II running vertically perpendicular to axis I, and axis III running horizontally perpendicular to axis I. As a result, there is complete freedom within the system of the present invention to align the laser light line sources to be configured to suit any arrangement of corridors or pathways within a building or other structure.

In a further alternative the laser light source may be provided with two or more different coloured laser light sources contained within the same unit allowing the colour of the laser line to be changed. This use of different colour can be used to assist in guiding people towards an exit.

Additional modules could be added which direct a laser beam outside of the curtain of beams described above with this laser being used to highlight a sign, such as an exit sign, by directing a beam of laser light onto the sign. As an alternative, the additional module could have a laser module fitted with a lens that causes the beam of laser light to form a shape such as a word or an image similar to a sign, thereby giving instruction to anyone seeing it. For example, where two doors in a corridor located opposite each other and, as previously described, a gap has been left in the laser curtain to indicate the presence of the door, a module is located above the door and directed to beam onto the space above the opposite door. This beam can draw out in laser light a sign including the word "exit" and an arrow pointing in the direction of the emergency nearest exit.

The invention claimed is:

1. An evacuation assistance apparatus for indicating a route, the apparatus comprising:

at least one source of electrical power;

a plurality of housings each of which contain at least one laser light line source for producing a beam of laser light that forms a linear line on a planar surface; and a plurality of said laser light sources arranged such that said linear lines together form a continuous linear line thereby indicating a route and that said at least one housing has at least one line adjuster for altering the laser light line so that the line extends vertically below said housing, thereby creating a break in said continuous linear line on the planar surface.

2. The apparatus according to claim 1, wherein said adjuster comprises at least one first adjuster for altering the angle of the laser light line source within the housing.

3. The apparatus according to claim 1, wherein said adjuster comprises at least one second adjuster for altering the length of said line of said laser light.

4. The apparatus according to claim 3, wherein said second adjuster comprises at least one mask for partially blocking said beam of laser light.

5. The apparatus according to claim 1, further comprising at least one retro-reflective tape for sticking to surfaces aligned with the position of said line of said laser light.

6. An evacuation assistance apparatus comprising:

a power source;

a surface; and a plurality of housings each of which comprise a line adjuster and a laser light line source configured to produce a beam of laser light on the surface; and wherein the line adjuster is adjustable between a first state in which beams of laser light generated by the laser light line sources collectively define a continuous line along the surface, and a second state in which the beams of laser light generated by the laser light line sources are discontinuous so as to be separated from one another by a gap on the surface.

7. The evacuation assistance apparatus of claim 6, wherein the surface is planar.

8. The evacuation assistance apparatus of claim 6, wherein in the second state a door is located in the gap on the surface.

9. The evacuation assistance apparatus of claim 6, wherein in the first state the beams of laser light include a first segment and a second segment that intersect on the surface to form the continuous line.

10. The evacuation assistance apparatus of claim 9, wherein in the second state the first segment and the second segment do not intersect on the surface to form the gap.

11. The evacuation assistance apparatus of claim 10, wherein in the second state, the first segment and the second segment are parallel on the surface.

12. An evacuation assistance apparatus comprising:

a power source;

a surface;

a first housing comprising a first line adjuster and a first laser light source configured to produce a first beam of laser light on the surface; and a second housing comprising a second line adjuster and a second laser light source configured to produce a second beam of laser light on the surface;

wherein the first line adjuster and the second line adjuster are adjustable between a first state in which the first beam of laser light and the second beam of laser light collectively define a continuous line along the surface, and a second state in which the first beam of laser light and the second beam of laser light do not intersect on the surface to form a gap on the surface.

13. The evacuation assistance apparatus of claim 12, wherein the surface is planar.

14. The evacuation assistance apparatus of claim 12, wherein in the second state a door is located in the gap on the surface.

15. The evacuation assistance apparatus of claim 12, wherein in the first state the first beam of laser light and the second beam of laser light intersect on the surface to form the continuous line.

16. The evacuation assistance apparatus of claim 12, wherein in the second state, the first beam of laser light and the second beam of laser light are parallel on the surface.

17. An evacuation assistance apparatus comprising:

a power source; and a plurality of housings each of which comprise a line adjuster and a laser light line source configured to produce a beam of laser light on a surface; and wherein the line adjusters is adjustable between a first state in which beams of laser light generated by the laser light line sources collectively define a continuous line along the surface, and a second state in which the beams of laser light generated by the laser light line sources are discontinuous so as to be separated from one another by a gap on the surface.

18. The evacuation assistance apparatus of claim 17, wherein in the first state the line adjuster is configured such that the beams of laser light include a first segment and a second segment that intersect on the surface to form the continuous line.

19. The evacuation assistance apparatus of claim 18, wherein in the second state the line adjust is configured such that the first segment and the second segment do not intersect on the surface to form the gap.

* * * * *